US008189835B2

(12) United States Patent
Dietz

(10) Patent No.: US 8,189,835 B2
(45) Date of Patent: May 29, 2012

(54) LOSS PROTECTION SYSTEM FOR HEARING AID DEVICES

(75) Inventor: Ferdinand Dietz, Stuttgart (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 366 days.

(21) Appl. No.: 12/511,087

(22) Filed: Jul. 29, 2009

(65) Prior Publication Data

US 2010/0027822 A1 Feb. 4, 2010

(30) Foreign Application Priority Data

Jul. 31, 2008 (DE) ..... 10 2008 035 668

(51) Int. Cl.
*H04R 25/00* (2006.01)

(52) U.S. Cl. ..... 381/315; 381/312

(58) Field of Classification Search ..... 381/23.1, 381/312, 314–315, 320–321, 331
See application file for complete search history.

(56) References Cited

U.S. PATENT DOCUMENTS

| | | | | |
|---|---|---|---|---|
| 5,479,522 | A * | 12/1995 | Lindemann et al. | 381/23.1 |
| 572,178 | A | 2/1998 | Anderson | |
| 5,991,419 | A * | 11/1999 | Brander | 381/312 |
| 7,245,731 | B2 * | 7/2007 | Niederdrank et al. | 381/315 |
| 7,330,558 | B2 * | 2/2008 | Arz et al. | 381/315 |

FOREIGN PATENT DOCUMENTS

DE 103 04 648 B3 8/2004

* cited by examiner

*Primary Examiner* — Suhan Ni

(57) ABSTRACT

The miniaturization and wearing comfort of hearing aid devices increasingly runs the risks of a hearing aid device worn on or in the ear of a user getting lost without user realizing. The invention relates to a hearing aid device system comprising a first and a second hearing aid device which is worn on the head or body of a user to provide an electronic loss protection system which is reliable and easily manageable for a user. The first hearing aid device controls a presence of a radio link and/or a signal level of a signal sent from the second hearing aid device and received in the first hearing aid device. If the radio link breaks or the signal level drops below a threshold value, an information signal is generated by the first hearing aid device to inform the user of the loss of the second hearing aid device.

15 Claims, 1 Drawing Sheet

LOSS PROTECTION SYSTEM FOR HEARING AID DEVICES

CROSS REFERENCE TO RELATED APPLICATIONS

This application claims priority of German application No. 10 2008 035 668.9 filed Jul. 31, 2008, which is incorporated by reference herein in its entirety.

FIELD OF THE INVENTION

The invention relates to a hearing aid device system comprising at least a first and a second device which can be worn on the head or body of a user, with a radio link being provided for wireless signal transmission between the devices.

BACKGROUND OF THE INVENTION

In many cases, hearing aid device wearers want use of the hearing aid devices to be as inconspicuous as possible. This has led to the development of very small hearing aid devices which can barely be seen by the respective user on and/or in the ear during wear. A frequently used, so-called open supply, in which the auditory canal of a supplied ear of the user is not closed by the hearing aid device, also contributes to the supply of a user with a hearing aid device still frequently barely being consciously perceived by the user. However, this has already repeatedly resulted in users losing their hearing aid devices during wear completely without realizing.

Mechanical means are known, by means of which hearing aid devices can be fastened to the ear, clothing, spectacles etc. of the respective user so that the hearing aid devices are secured if they unintentionally detach from the ear. Holders are also known, which effect an additional fastening on the ear using magnets and as a result prevent the loss of the relevant hearing aid device.

Mechanical fastening means are disadvantageous in that they frequently fail to bring about the desired effect (e.g. magnetic holders) or are cumbersome to manage (e.g. spectacle fasteners).

DE 103 04 648 B3 discloses a hearing aid device system comprising a first and a second hearing aid device as well as a remote controller, with a radio link being realized for wireless signal transmission between the three devices.

The patent application U.S. Pat. No. 5,721,783 discloses a hearing aid device system comprising a hearing aid device which can be worn in the left and in the right ear respectively and a processor unit which can be worn on the body. With the known hearing aid device system, the retrieval of a lost hearing aid device is facilitated such that the processor unit which can be worn on the body emits a signal which can be detected by the user, if during operation in a search mode said signal enters into the reception range of a lost hearing aid device.

SUMMARY OF THE INVENTION

The object of the present invention is to provide a reliable and easily manageable loss protection system for hearing aid devices.

This object is achieved by a hearing aid device system with the features according to the independent claim. Advantageous developments are characterized by the dependant claims.

With a hearing aid device, an input transducer records an input signal and converts it into an electrical input signal. At least one microphone, which records an acoustic input signal and converts it into an electrical input signal is usually used as an input transducer. Modern hearing aid devices frequently include a microphone system comprising several microphones in order to achieve a reception which is dependent on the direction of arrival of acoustic signals, a directional receiving pattern. Telephone coils or antenna for recording electromagnetic input signals and converting said signals into electrical input signals are also however customary as input transducers. The input signals converted into electrical input signals by the input transducer are supplied to a signal processing unit for further processing and amplification. In order to offset the individual hearing loss of a user, the further processing and amplification generally takes place as a function of the signal frequency of the input signal. The signal processing unit supplies an electrical output signal at its output, which is supplied to the ear of the hearing aid device wearer by way of an output transducer so that this perceives the output signal as an acoustic signal. Receivers are customarily used as output transducers, said receivers generating an acoustic output signal. Acoustic transducers for generating mechanical oscillations are however also known, said mechanical oscillations directly causing certain parts of the ear, like for instance the auditory ossicles, to vibrate. Furthermore, output transducers are also known which directly stimulate the nerve cells of the ear. A hearing aid device also includes a voltage source (battery or rechargeable battery) for supplying power to the electronic components. Other control elements (on/off switch, program switch, volume controller etc.) may also exist. All electronic components in a hearing aid device can be accommodated in a single housing. It is however also possible for the electronic components of a hearing aid device to be distributed between several devices or assemblies, the receiver of a hearing aid device which can be worn behind the ear can also be located in an otoplastic which can be worn in the ear for instance, with a wired or radio link therefore existing between the part of the relevant hearing aid device which can be worn behind the ear and the part which can be worn in the ear.

The hearing aid device system according to the invention includes at least one first and one second device which can be worn on the head or body of a user, between which a radio link is provided for wireless data transmission. The first and the second device are preferably an in-the-ear (ITE) or a behind-the-ear (BTE) hearing aid device or a hearing aid device which can be worn on the body. The second device can however also be embodied as a remote controller for the first device or as an external processor unit which can be worn on the body. The hearing aid device system according to the invention can also include more than two devices, between which a wireless signal transmission is provided, for instance two hearing aid devices which can be worn on or in the ear as well as a third device which is a remote controller for user-friendly operation of these two hearing aid devices by means of the user.

A wireless signal transmission between two hearing aid devices always enables these to be operated in the same auditory program for instance or for a manual change in the volume setting on one of the two hearing aid devices to also automatically effect a corresponding change in the volume setting in the case of the second hearing aid device.

According to the invention, the presence and/or the quality of the radio link between the components of the hearing aid device system and in particular between two hearing aid devices is monitored, so that a break in the radio link or the drop in the signal level of a signal received in a hearing aid device by way of the radio link to below a certain threshold value is immediately automatically detected. According to the invention, this triggers the generation of a signal which can be perceived by a user, which informs the user that the radio link is interrupted. Since the coverage of the radio link between the two hearing aid devices of an inventive hearing aid device system is narrowly restricted, the user is thus immediately informed of a loss by means of the hearing aid device which remains in the ear. The coverage of a remote controller which is provided in order to control a hearing aid device is restricted however to a few meters, so that the user is then also informed about the possible loss of a hearing device if the link to the remote controller is interrupted. The user is therefore always already aware of a loss if he/she is still in close proximity to the lost device. This facilitates the retrieval of said lost device.

The information signal may be an acoustic signal, but also a signal which can be detected in an optical or tactile fashion, which immediately informs the user of a broken radio link or poor reception quality between at least two devices in the relevant hearing aid device system.

It is apparent that during the everyday operation of a hearing aid device system comprising at least two hearing aid devices, between which a radio link for signal transmission exists, interruptions in the radio link may then also occasionally occur if both hearing aid devices are in the usual wearing position. Interruptions of this type may be caused for instance by strong electromagnetic interference signals. It is therefore expedient not to react to each interruption in the radio link with a corresponding information signal but instead to only then generate an information signal of this type if the radio link is interrupted for a certain period of time and/or if the signal level in the receiving device does not reach the threshold value for a certain period of time.

The period of time and/or the threshold value can advantageously be set in order to adjust to the individual conditions of a user. A setting of this type can take place for instance during the programming of the hearing aid device by means of a programming device.

Different periods of time and/or threshold values can advantageously also be set for different operating states in a relevant hearing aid device. If due to an analysis of the surrounding situation for instance the hearing aid device identifies that it is in a noisy environment, a longer period of time, compared with a quiet auditory environment, can be activated for instance during the period of time in this situation. Immediately after switching on a hearing aid device, it may also be expedient to firstly suppress a corresponding information signal. This prevents the hearing aid device, which is initially fastened to and/or in the ear, from immediately reacting with a corresponding information signal when a hearing aid device system is applied, provided the second hearing aid device of the relevant hearing aid device system is still not activated or is still not in the wearing position provided.

According to one development of the invention, provision is made for the information signal generated by the hearing aid device signal to be adjustable to an individual user. A collection of acoustic signals (tones, tone sequences, melodies etc.) is advantageously available to the user, of which he/she can select one or several depending on individual preferences. It is therefore possible for instance for the left hearing aid device, the right hearing aid device and the remote controller of an inventive hearing aid device system to output different signals which can be detected by the user when the radio link is interrupted. In addition to acoustic signals which can be detected in an optical or tactile fashion can be generated and output by means of the remote controller. Advantageously, in addition to selecting the information signal per se, certain properties of a signal of this type can be individually adjusted. The volume and frequency of an acoustic information signal can be adjusted for instance in accordance with the wishes and requirements of the respective user.

If an information signal indicates to a user according to the invention that a hearing aid device of a relevant hearing aid system is lost, one development of the invention provides means that facilitate the retrieval of a lost hearing aid device. The amplification of a radio signal received by the remaining hearing aid device or the remote controller and by the lost hearing aid device can be increased for instance so that an approximate estimation can be made relating to the distance between the relevant devices. With the remote controller or the remaining hearing aid device, a search function can advantageously be triggered by the manual operation or speech input on the remote controller or the remaining hearing aid device. The search function in the lost hearing aid device advantageously effects the output of a warning signal with maximum amplification so that the lost hearing aid device can also be found again by the acoustic signal generated thereby.

BRIEF DESCRIPTION OF THE DRAWINGS

The invention is described in more detail below with reference to an exemplary embodiment, in which.

DETAILED DESCRIPTION OF THE INVENTION

Figure 1:
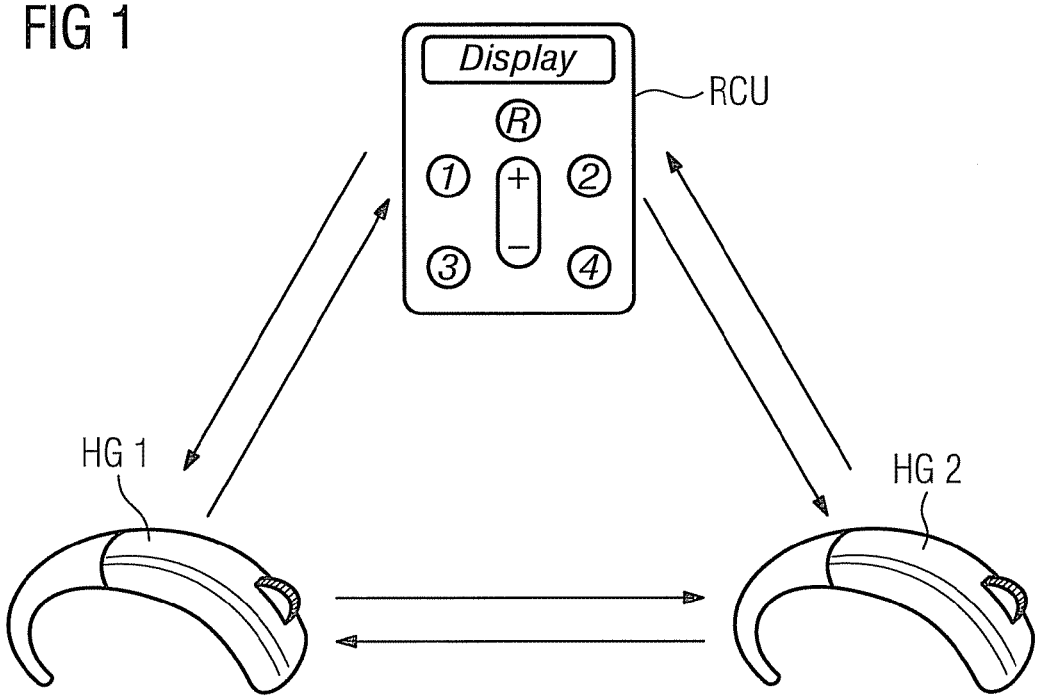
FIG. 1 shows a hearing aid device system according to the invention.

The hearing aid device system which is apparent from the exemplary embodiment according to FIG. 1, in addition to the two hearing aid devices HG 1 and HG 2 which can be worn behind the ear, also has a remote controller RCU. With the hearing aid device system according to the exemplary embodiment, a wireless bidirectional link is possible both between the remote controller RCU and the two hearing aid devices HG 1 and HG 2 as well as between the two hearing aid devices HG 1 and HG 2. To this end, there is a radio link between two devices of the hearing aid device system in each instance, by way of which the signals can be transmitted wirelessly and bidirectionally. By manually operating a program selection key on the remote controller, it is as a result possible to simultaneously switch both hearing aid devices HG1 and HG2 to the same auditory program. The manual actuation of a volume controller on one of the two hearing aid devices, for instance on the hearing aid device HG1, also effects a simultaneous adjustment of the volume setting in the second hearing aid device HG 2.

Figure 2:
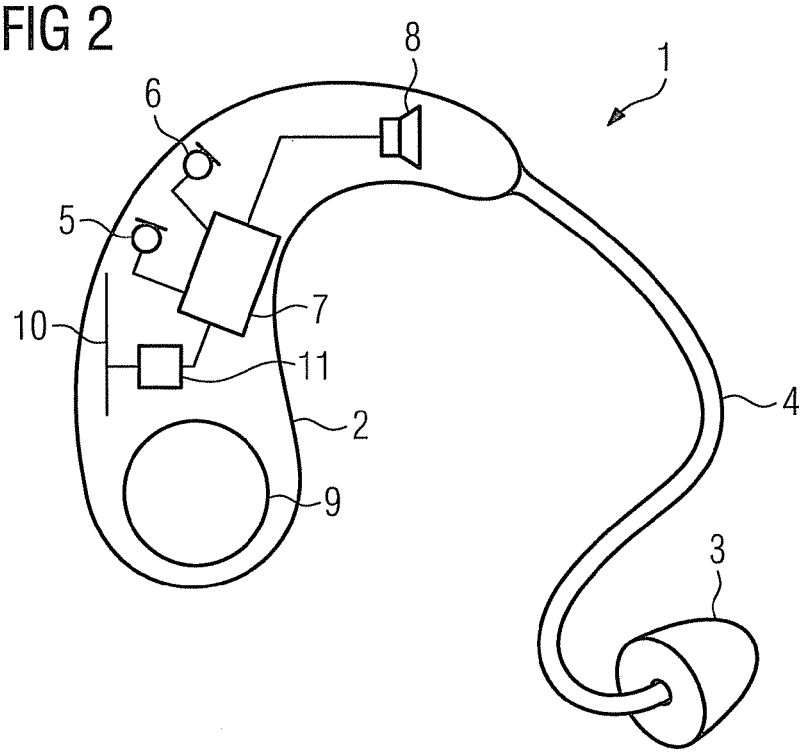
FIG. 2 shows an individual hearing aid device from a hearing aid device system according to the invention.

The structure of an exemplary hearing aid device according to the exemplary embodiment in FIG. 1 is shown in FIG. 2. The hearing aid device 1 which is apparent therefrom and can be worn behind the ear has a housing 2 which can be worn behind the ear, an otoplastic 3 which protrudes into the auditory canal during wear and a sound tube 4, which is used to support the hearing aid device 1 on the ear and to convey the sound between the housing 2 and the otoplastic 3. Two microphones 5 and 6 are available in the hearing aid device 1 to record sound, said microphones being interconnected with a directional microphone system. The microphone signals emanating therefrom are fed to a signal processing unit 7 for processing and frequency-dependent amplification. This generates an electrical output signal, which is converted into an acoustic output signal in the receiver 8 and is fed to the ear of a user by way of the sound tube 4 and the otoplastic 3. A battery 9 is also available to provide power to the electronic components of the hearing aid device 1.

The hearing aid device 1 has a transmit and receive antenna 10 for the wireless signal transmission between the hearing aid device 1 and an additional device, for instance an additional hearing aid device, a remote controller, a programming device etc. The signals received thereby are firstly supplied to a signal evaluation and control facility 11, before they are supplied to the signal processing unit 7, if necessary after further processing. According to the invention, the signal evaluation and control facility 11 checks whether a certain electromagnetic signal which emanates from one hearing aid device 1 to the second hearing aid device which is similar in structure thereto can be received by way of the antenna 10 and if necessary the signal level of a relevant signal. If no signal is received or the signal level lies below an adjustable threshold value, a control signal is generated in the signal evaluation and control facility 11 and is transmitted to the signal processing unit 7, which leads to the output of an information signal stored in a memory of the signal processing unit 7 by way of the receiver 8. A user of the hearing aid device 1 is as a result informed that the second hearing aid device of the relevant hearing aid device system is located outside the regular distance in respect of the hearing aid device 1. The user is thus informed by the hearing aid device 1 of a possible loss of the second hearing aid device of the relevant hearing aid device system.

According to advantageous developments of the invention, the hearing aid device 1 does not respond immediately with each break in the radio link and/or drop in the signal level to below the threshold value, but only if the relevant state stops for a certain period of time. The period of time and/or the threshold value can advantageously be individually adjusted by programming the hearing aid device 1 and in particular the signal evaluation and control facility 11.

The invention claimed is:

1. A hearing aid device system, comprising:
- a first device;
- a second device; and
- a radio link for wirelessly transmitting a signal between the first device and the second device,
- wherein the hearing aid device system is configured to:
  - generate an information signal if the radio link between the first device and the second device breaks or if a signal level of a signal sent by the first device and received by the second device does not reach a threshold value at a site of the second device, and
  - transmit the information signal to a user of the hearing aid device system.

2. The hearing aid device system as claimed in claim 1, wherein the first device and the second device can be worn on a head or a body of the user.

3. The hearing aid device system as claimed in claim 1, wherein the first device is a first hearing aid device which can be worn on or in a left ear of the user and the second device is a second hearing aid device which can be worn on or in a right ear of the user.

4. The hearing aid device system as claimed in claim 3, wherein the information signal is emitted from one of the first and the second hearing aid devices.

5. The hearing aid device system as claimed in claim 1, wherein the first device is a hearing aid device which can be worn on or in an ear of the user and the second device is a remote controller for the hearing aid device.

6. The hearing aid device system as claimed in claim 5, wherein the information signal is emitted from the hearing aid device or the remote controller.

7. The hearing aid device system as claimed in claim 1, wherein the information signal is an acoustic signal that is detectable by the user.

8. The hearing aid device system as claimed in claim 1, wherein the information signal is emitted if the radio link is interrupted for a certain period of time or if the signal level at the site of the second hearing aid device drops below the threshold value for a certain period of time.

9. The hearing aid device system as claimed in claim 8, wherein the period of time is adjustable.

10. The hearing aid device system as claimed in claim 9, wherein different periods of time are adjustable for different operating states of the hearing aid device system.

11. The hearing aid device system as claimed in claim 10, wherein a period of time for an operating state is adjustable immediately after the hearing aid device system has been switched on.

12. The hearing aid device system as claimed in claim 1, wherein the threshold value is adjustable.

13. The hearing aid device system as claimed in claim 1, wherein the information signal is adjusted to the user.

14. The hearing aid device system as claimed in claim 1, wherein a search function is activated for retrieving a lost component of the hearing aid device system.

15. A method for protecting a loss of a component of a hearing aid device system, comprising:
- providing a first device;
- providing a second device;
- wirelessly transmitting a signal between the first device and the second device by a radio link;
- generating an information signal if the radio link between the first device and the second device breaks or if a signal level of a signal sent by the first device and received by the second device does not reach a threshold value at a site of the second device; and
- transmitting the information signal to a user of the hearing aid device system.

* * * * *